US006109472A

United States Patent [19]

Gibier

[11] Patent Number: 6,109,472

[45] Date of Patent: Aug. 29, 2000

[54] DEVICE FOR DELIVERING TICKETS FORMED BY STRIP SECTIONS

[75] Inventor: Gilles Gibier, Jouy en Josas, France

[73] Assignee: Axiohm Transaction Solutions, Inc., Ithaca, N.Y.

[21] Appl. No.: 09/194,812

[22] PCT Filed: Jun. 2, 1997

[86] PCT No.: PCT/FR97/00956

§ 371 Date: Dec. 2, 1998

§ 102(e) Date: Dec. 2, 1998

[87] PCT Pub. No.: WO97/46976

PCT Pub. Date: Dec. 11, 1997

[30] Foreign Application Priority Data

Jun. 3, 1996 [FR] France ..... 96 06803

[51] Int. Cl.[7] ..... B65H 1/00

[52] U.S. Cl. ..... 221/33; 83/649

[58] Field of Search ..... 221/33, 45, 46, 221/36, 40, 282, 253; 83/433, 456.5, 439, 649

[56] References Cited

U.S. PATENT DOCUMENTS

| | | | |
|---|---|---|---|
| 4,690,344 | 9/1987 | Yokota | 242/55.53 |
| 5,013,388 | 5/1991 | Goodwin et al. | 156/384 |

FOREIGN PATENT DOCUMENTS

| | | |
|---|---|---|
| 0045870 | 2/1982 | European Pat. Off. . |
| 0330847 | 9/1989 | European Pat. Off. . |
| 0764585 | 3/1997 | European Pat. Off. . |
| 913245 | 12/1962 | United Kingdom . |

*Primary Examiner*—Kenneth W. Noland
*Attorney, Agent, or Firm*—Salzman & Levy

[57] ABSTRACT

The invention provides a device for dispensing tickets in the form of segments cut off from a single paid-out strip, the device comprising a two-portion container, each portion of the container carrying a cutter blade, the portions of the container being movable relative to each other between a first relative position in which the blades are in a position to cooperate with each other for cutting off a ticket, and a second relative position in which the blades are remote from each other so as to leave sufficient space between them to give easy access to the path of the strip. According to one of the characteristics of the invention, the device comprises a ticket extractor situated downstream from the blades in the payout direction of the strip, the extractor comprising respective rollers coupled to each of the portions of the container such that, in the first above-mentioned position, the rollers are in contact with each other along a generator line, and, in the second position, the rollers are spaced apart from each other by a distance that is not less than the distance between the blades when in their second position.

9 Claims, 1 Drawing Sheet

DEVICE FOR DELIVERING TICKETS FORMED BY STRIP SECTIONS

FIELD OF THE INVENTION

The present invention relates to a device for dispensing tickets or labels from a strip by cutting successive segments from the end of the strip which is inserted into a cutter mechanism.

BACKGROUND OF THE INVENTION

In numerous applications, it is the practice to supply a ticket or a label which, for example, constitutes a receipt for a transaction or an element for identifying an object or a product, . . .

Such tickets are taken from a strip in the form of a roll housed in a container and paid out by a drive mechanism which guides the end of the strip between the blades of a cutter unit. In conventional manner, the drive mechanism is the drive mechanism of a printer, in particular a thermal printer, serving to put a message on the ticket or label (data, bar code, letters or digits, . . . ).

In some devices, after the segment of strip has been cut off it is left to its own devices and falls under gravity into a receptacle from which it can be taken by a user. In other devices, the ticket is taken by a conveyor to the location where the user can take hold of it. The conveyor is a unit that complicates the device since it uses mechanical members which come into contact with the segment, thereby constituting an additional constraint on strip positioning and giving rise to poor operation of the overall assembly (wear, breakdowns, jamming, . . . ). This is particularly true when the strip is designed to provide adhesive labels, i.e. labels which are adhesive on one face.

SUMMARY OF THE INVENTION

The present invention seeks to remedy those drawbacks by proposing means for dispensing tickets or labels, which means are much simpler in their structure and in their organization relative to the cutter units and to the roll of strip.

To this end, the invention thus provides a device for dispensing tickets in the form of segments cut off from a single paid-out strip, the device comprising a two-portion container, each portion of the container carrying a cutter blade, the portions of the container being movable relative to each other between a first relative position in which the blades are in a position to co-operate with each other for cutting off a ticket, and a second relative position in which the blades are remote from each other so as to leave sufficient space between them to give easy access to the path of the strip. According to one of the characteristics of the invention, the device comprises a ticket extractor situated downstream from the blades in the strip payout direction, the extractor comprising respective rollers coupled to each of the portions of the container such that, in the first above-mentioned position, the rollers are in contact with each other along a generator line, and, in the second position, the rollers are spaced apart from each other by a distance that is not less than the distance between the blades when in their second position.

The device of the invention thus opens fully, so that installing a roll of strip or taking action in the event of a breakdown or of jamming is made very much simpler. It suffices merely to separate the two portions of the container from each other to gain access in one operation to all of the path followed by the strip, both upstream and downstream from the cutter mechanism.

In a preferred embodiment, one of the motor-driven rollers is carried by one portion of the container which is fitted with the motor-driven cutter blade of the cutter mechanism. This container portion is preferably the larger portion, and the portion of the device which supports the roll of strip, while the other portion can be little more than a lid fitted with non-motor-driven cutting and extraction elements.

BRIEF DESCRIPTION OF THE DRAWINGS

Other characteristics and advantages appear from the following description given below of an embodiment of the invention.

Reference is made to the accompanying drawing, in which.

DETAILED DESCRIPTION OF THE PREFERRED EMBODIMENT

Figure 1:
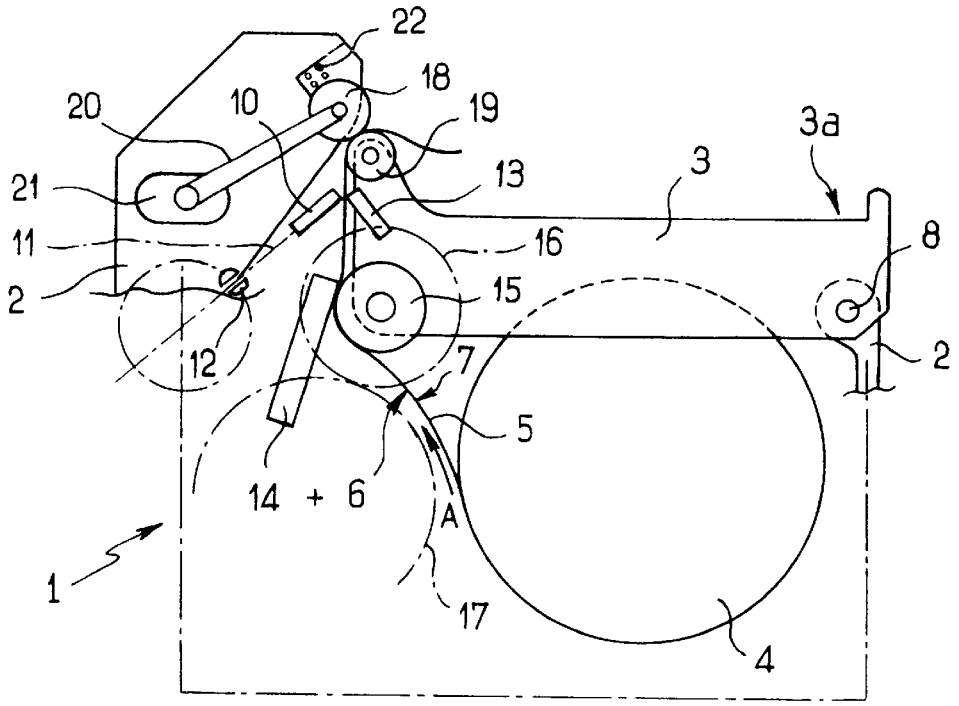
FIG. 1 is a diagrammatic view of a device of the invention in its closed state.

In the figures, both of which constitute diagrammatic side views, there can be seen a device for dispensing tickets or labels, which device comprises a container 1 having two main portions 2 and 3 which are movable relative to each other. In the figures, these portions are not completely separable from each other, however the invention covers a container made of two portions that can be separated completely from each other.

Portion 2 of the container is generally in the form of a box suitable for receiving a roll 4 of a strip of paper 5, e.g. paper that is heat-sensitive on one of its faces 6 and covered in adhesive on its other face 7.

Figure 2:
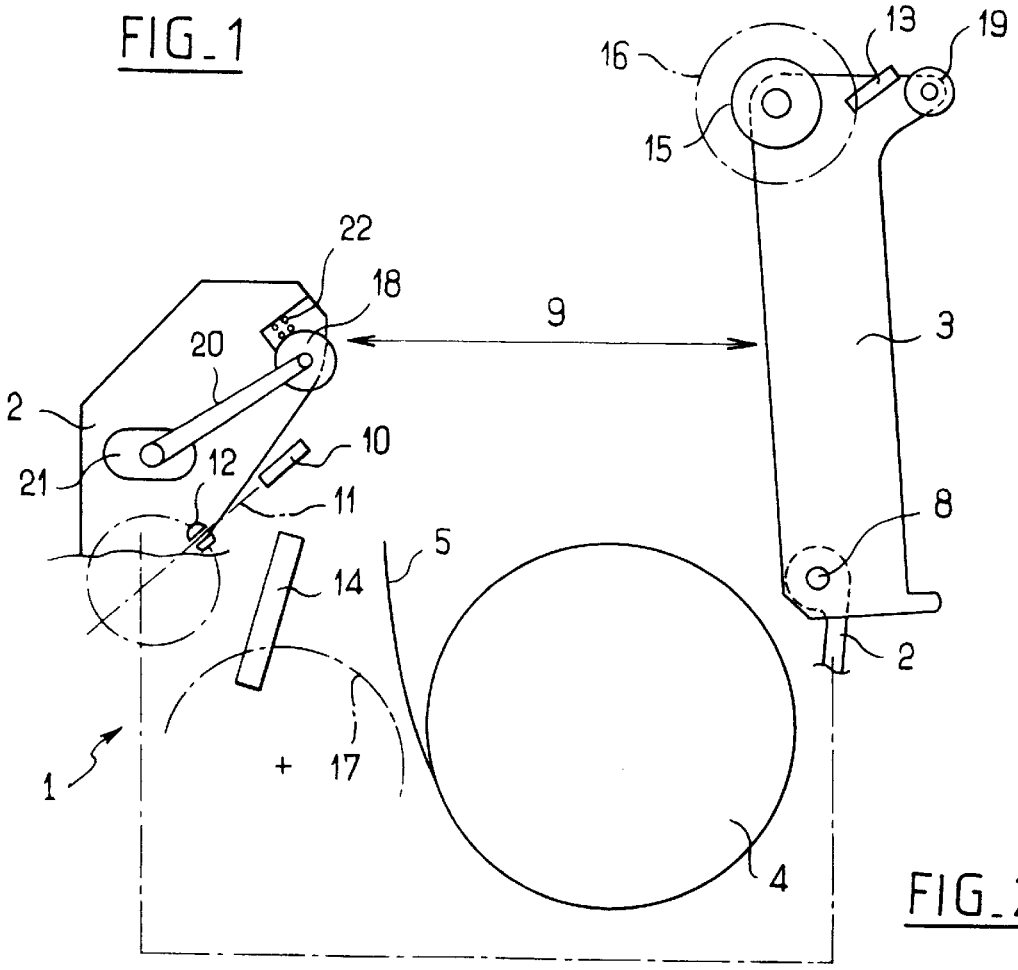
FIG. 2 is the same view of the device, but shown in its open state.

In this case, the other container portion 3 is in the form of a lid which is hinged at one of its ends about an axis 8 carried by the box 2 so as to pivot between a first position as shown in FIG. 1 which corresponds to the container being in its closed position with the end of the lid 3 remote from its hinge cooperating with a portion of the box 2 that is remote from said hinge; and a second position as shown in FIG. 2 in which the lid 3 leaves open an opening 9 into the box 2, e.g. giving access to a housing inside said box for receiving the roll 4.

In conventional manner, close to its opening 9 remote from the hinge 8, the box 2 has a cutter blade 10 which is mounted to oscillate about its longitudinal axis which extends parallel to the hinge axis 8, and perpendicularly to the plane of the figures. This blade is caused to oscillate by means of a drive mechanism carried by the box 2 and comprising, for example, a connecting rod 11 coupled to the blade 10 and to a rotary crank 12 coupled to a rotary motor.

Likewise in conventional manner, the lid carries a "stationary" cutter blade 13 at its end remote from its hinge 8. This blade bears against the oscillating blade when the container is in its closed state (FIG. 1), and the bearing pressure is determined by a resilient mechanism (not shown) that is disposed between the lid and the blade 13, which blade may for this purpose be mounted to pivot to a small extent about its fixing axis relative to the lid 3 and extending perpendicularly to the plane of the figures.

When the container is open (FIG. 2), the blade 13 is moved away from the blade 10. The distance between them is such that there exists a gap which is large enough to give access to the strip 5, and also, if the roll 4 is loaded through the opening 9, large enough to enable the roll to pass between the blades.

In the device shown in the figures, the container also includes means for printing on one of the faces of the strip. In this case, these means are represented by a thermal printer having a print head 14 carried by the box 2 and a capstan or backing roller 15 carried by the lid 3. When the container is in its closed state, the print head 14 presses against one of the generator lines of the backing roller 15 via a line of heatable points that it includes for printing dots on the thermally sensitive face of the strip 5 as it passes between them.

It will be observed that these print means are situated upstream from the cutter blades 10 and 13 in the payout direction A of the strip 5. When the container is closed, the strip 5 is driven through the print head by means of the capstan 15 which is motor-driven. The capstan is constrained to rotate, for example, with a gear wheel which, when the lid 3 is in its closed position, meshes with the outlet wheel 17 of a motor-and-gearbox unit carried by the box 2. When the container is open (FIG. 2), the wheel 16 is uncoupled from the wheel 17 since the capstan 15 is remote from the head 14, as is the blade 13 from the blade 10.

The surface of the capstan 15 is compatible with the adhesive carried by the strip 5 on its face 7 so as to ensure that there exists sufficient friction between them for the strip to be driven, while avoiding any adhesion that would tend to cause the strip to be wound around the capstan.

Downstream from the cutter blades 10 and 13 (relative to the travel direction A of the strip), the device of the invention includes means for extracting the tickets or labels that have been cut off by the blades 10 and 13. These means comprise a set of rollers 18 & 19 which pinch the strip of paper as it passes between them. The roller 18 is carried by the portion of the container that forms the box 2 and it is motor-driven, e.g. by transmission from a belt 20 which connects a pulley fitted to the roller 18 to a motor 21. The roller 19 is freely mounted on the lid portion 3 at its end remote from the hinge 8. A spring 22 represents means for pressing the roller 18 against the roller 19 when the container is closed. Naturally the roller 18 is, for this purpose, capable of moving to a small extent in a circularly arcuate slot formed in the box 2 and centered on the outlet shaft of the motor 21. In a variant that is not shown, it is the roller 19 which is pressed against the roller 18 by a spring coupled between the roller 19 and the lid 3.

In the embodiment described above, all of the shafts of all of the rotary elements of the device of the invention are parallel to the hinge axis 8 between the two portions of the container. It would not go beyond the ambit of the invention to provide for all of the shafts to be parallel to one another without being parallel to the hinge axis which could, for example, be orthogonal thereto, in which case the lid would open about an axis parallel to the plane of the figures. It is also possible for the two portions 2 and 3 of the container 1 to be completely separable, with the container being closed by snap-fastening one portion onto the other.

It will be understood that the device of the invention makes it easy to place a roll 4 in its housing inside the container 1 through the wide-open opening 9 presented when the lid 3 is tilted open (FIG. 2). Thereafter the operator can bring the lid 3 back down while holding the end of the strip outside the container. The strip is then in place between the print head 14 and the capstan 15, between the blades 10 and 13, and between the rollers 18 and 19 of the extractor.

In operation, during printing, the strip 5 is driven by the capstan 15 and by the extractor. At the end of printing, the capstan is stopped while the cutter blade 10 is driven so as to cut off the end of the strip, thereby separating a ticket or a label. The drive roller 18 of the extractor can be kept rotating so that by friction it maintains tension in the strip while it is being cut, thereby making cutting easier.

In a first application, at the end of the cutting operation, the extractor is switched off and a label is held pinched between the rollers 18 and 19 via its rear end. It then suffices for the user to take hold of the label and extract it by exerting a small amount of traction.

This way of operating the device is advantageous when it is designed to dispense adhesive labels. Holding the label prevents it from falling and sticking to some other element of the device. Naturally, the surface nature of the roller 18 is designed so as to enable this roller to rotate while sliding over the face 6 of the strip 5, while the surface nature of the roller 19 should be identical to that of the capstan 15. It is preferable to drive the roller 18 so that it has a peripheral speed that is slightly greater than the speed imparted to the strip by the capstan 15 so as to maintain a small amount of tension in the strip as it goes past the cutter blades.

Printing the next label causes the end of the strip to pass between the blades which, after the preceding cutting operation, are held spaced slightly apart from each other (in conventional manner). The strip is then received in the inlet angle of the extractor which, being put into operation simultaneously with the print means, constitutes a gulley for taking the strip. If the distance between the cutter unit and the extractor makes it necessary, it is possible to provide complementary guide surfaces for guiding the strip between the box 2 and the lid 3 between the blades and the extractor.

In other applications of the invention, when the tickets that are dispensed are not adhesive, the operating sequences of the extractor differ from those described above. When a plurality of tickets are to be dispensed that have been printed one after another for the purpose of supplying the user with a stack of tickets, the extractor can operate continuously during all of the sequences for printing the various tickets. In this way, each ticket as it is cut off is entrained and ejected by the extractor which propels it towards a receptacle, e.g. a kind of cup or dish 3*a* formed in the lid 3. Tickets ejected in this way stack up on one another in the cup, and the user can take hold of a stack of tickets organized as a function of the various printing and cutting sequences.

Sensors are provided on the strip path for detecting its presence firstly for the purpose of organizing operating sequences (setting into rotation and stopping) of the extractor depending on whether it is to operate as a retaining clamp or as an ejector, and secondly to actuate an alarm in the event of faulty delivery of the strip or of a ticket. Under such circumstances, for any required action, all an operator needs to do is open the container to gain access in highly practical manner to the entire path followed by the strip, and then remedy in simple and rapid manner any fault that may have occurred therein.

What is claimed is:

1. A device for dispensing tickets in the form of segments cut off from a single paid-out strip (5), the device comprising a two-portion (2, 3) container (1), each portion (2, 3) of the container (1) carrying a cutter blade (10, 13), the portions (2, 3) of the container (1) being movable relative to each other between a first relative position in which the blades (10, 13) are in a position to co-operate with each other for cutting off a ticket, and a second relative position in which the blades (10, 13) are remote from each other so as to leave sufficient space (9) between them to give easy access to the path of the strip (5), the device comprising a ticket extractor situated downstream from the blades (10, 13) in the payout direction (A) of the strip (5), the extractor comprising respective rollers (18, 19) coupled to each of the portions (2, 3) of the container such that, in the first above-mentioned position, the rollers (18, 19) are in contact with each other along a generator line, and, in the second position, the rollers (18, 19) are spaced apart from each other by a distance that is not less than the distance between the blades (10, 13) when in their second position.

2. A device according to claim 1, wherein one of the rollers (18) is coupled to a motor (21) for driving it about its own axis.

3. A device according to claim 1, including a resilient member (22) urging one of the rollers (18) against the other roller (19) when they are in the first position.

4. A device according to claim 1, wherein one of the portions (3) of the container (1) is hinged to the other portion (2) about an axis (8) parallel to the axis of the rollers (18, 19) and situated at an end of said portion (3) remote from its end fitted with the corresponding roller (19).

5. A device according to claim 2, wherein one of the cutter blades (10) is motor-driven and the motor-driven roller (18) is carried by the same portion (2) of the container (1) as it contains the motor-driven blade (10).

6. A device according to claim 2, wherein the rotary drive means (20, 21) of the motor-driven roller (18) are activated before the end of the strip (5) reaches said roller, and are deactivated before the rear end of the ticket reaches said roller, so as to co-operate, when stopped, with the non-motor-driven roller (19) to form a clamp for holding the ticket.

7. A device according to claim 2, wherein the drive means (20, 21) of the motor-driven roller (18) are activated before the end of the strip (5) reaches said roller, and are deactivated before the rear end of the ticket has gone past the contacting generator lines of the two rollers (18, 19) so as to form a ticket ejector.

8. A device according to claim 7, wherein one (3) of the container portions (2, 3) includes a cup (3*a*) for receiving ejected tickets.

9. A device according to claim 1, wherein upstream from the cutter blades (12, 13) in the tape payout direction (A), it included a thermal printer member having a print head (14) carried by one (2) of the portions of the container, and a backing roller (15) carried by the other portion (3).

* * * * *